United States Patent [19]

Phillips

[11] Patent Number: 4,978,095

[45] Date of Patent: Dec. 18, 1990

[54] HARNESS FOR MOISTENED-TISSUE DISPENSER

[75] Inventor: Gregory Phillips, Englewood Cliffs, N.J.

[73] Assignee: Plus Marketing Corp., Fort Lee, N.J.

[21] Appl. No.: 466,016

[22] Filed: Jan. 16, 1990

[51] Int. Cl.[5] ..... A47K 1/08

[52] U.S. Cl. ..... 248/312; 206/233; 248/318; 248/327

[58] Field of Search ..... 248/312, 312.1, 311.3, 248/315, 327, 323, 104, 311.2, 318; 206/233

[56] References Cited

U.S. PATENT DOCUMENTS

| | | | |
|---|---|---|---|
| 2,295,318 | 9/1942 | Able | 248/312.1 X |
| 2,518,862 | 8/1950 | Cain et al. | 248/104 |
| 2,755,051 | 7/1956 | Cook | 248/311.3 X |
| 2,841,349 | 7/1958 | Charles | 248/104 |
| 3,807,679 | 4/1974 | Burke et al. | 248/311.3 X |
| 4,004,687 | 1/1977 | Boone | 206/233 |
| 4,106,616 | 8/1978 | Boone | 206/233 |
| 4,106,617 | 8/1978 | Boone | 206/233 |
| 4,206,529 | 6/1980 | Neumann | 206/233 X |
| 4,235,333 | 11/1980 | Boone | 206/233 |
| 4,691,473 | 9/1987 | Ragen | 248/315 X |

*Primary Examiner*—Ramon O. Ramirez

*Attorney, Agent, or Firm*—Michael Ebert

[57] ABSTRACT

A harness for hitching a moistened-tissue dispenser onto a conventional toilet-tissue roll holder so that a user has ready access to either type of tissue. The dispenser is formed by a cylindrical can housing a roll of pre-moistened tissue perforated along its length to provide individual tissues that are successively withdrawn through an orifice in the cover of the can below which is an annular groove. The harness, which is formed of flexible plastic material, consists of a hoop adapted to encircle the can groove and a pair of straps extending from the hoop at diametrically opposed positions. Adjacent the free end of each strap is a hole, making it possible to link the strap to an end journal of a spring-biased, retractable spindle supporting the toilet-tissue roll, the spindle journals being received in bearing sockets on the holder. The straps suspend the moistened-tissue dispenser below the toilet-tissue roll.

6 Claims, 1 Drawing Sheet

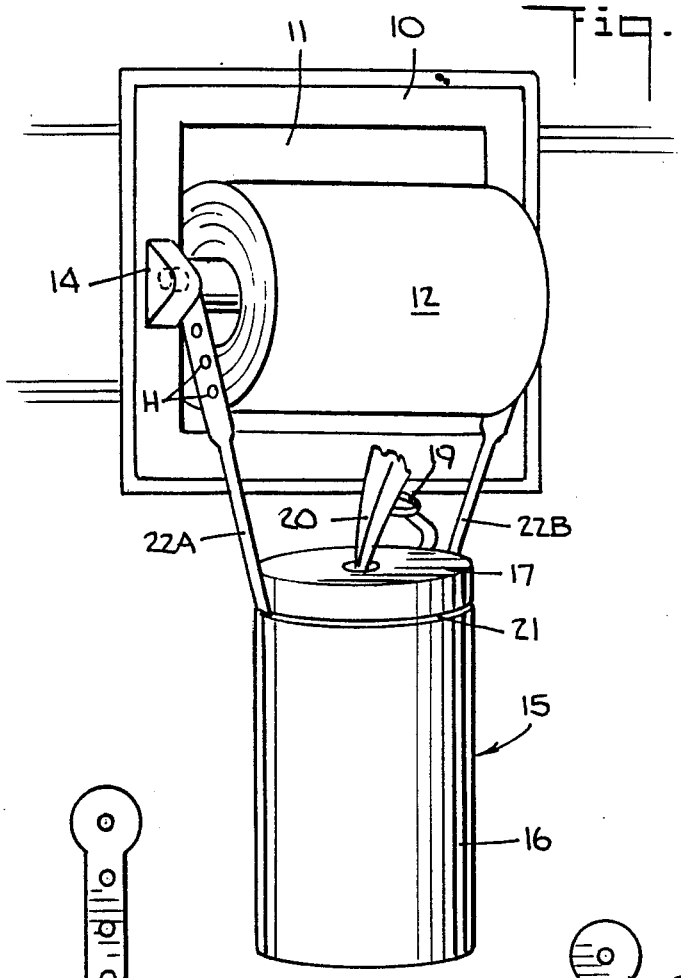
Fig. 1.
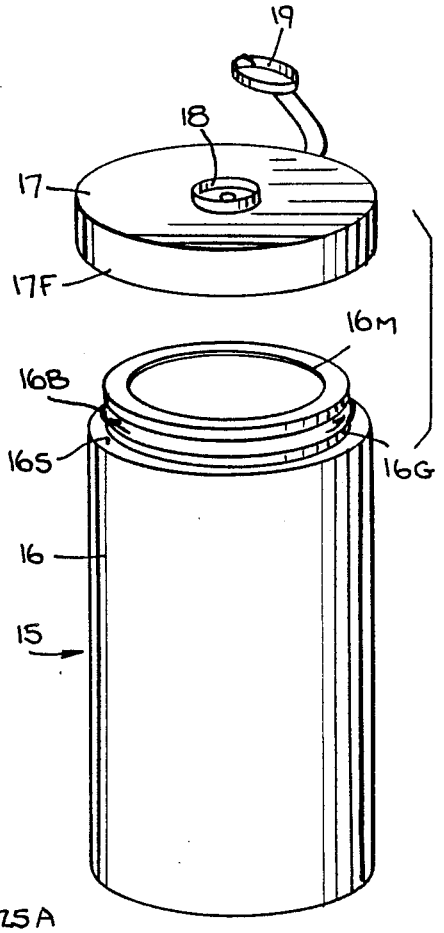
Fig. 2.
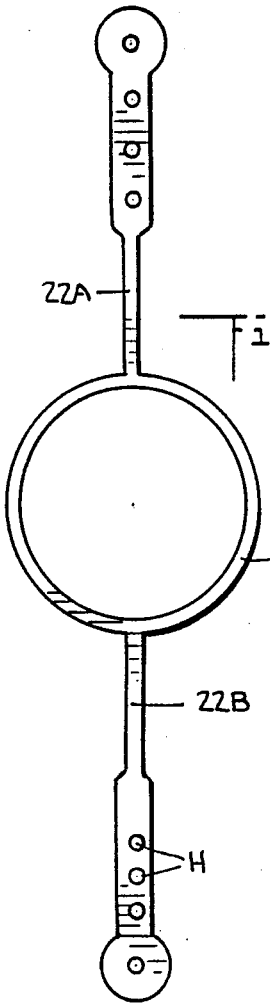
Fig. 4.
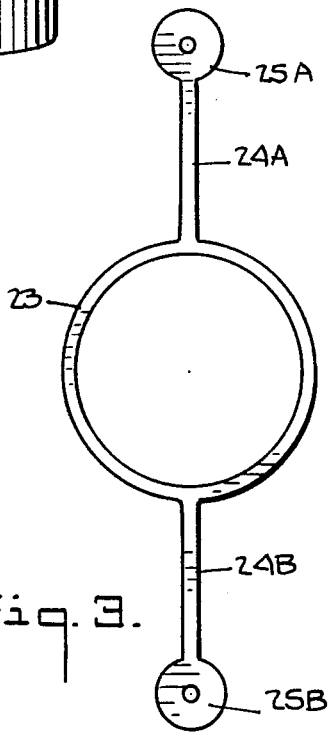
Fig. 3.
Fig. 5.
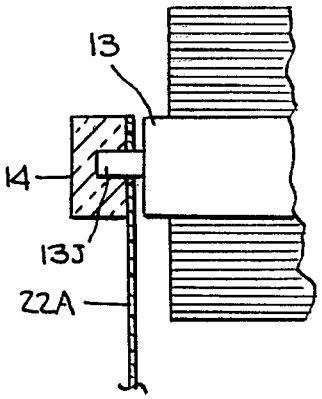

HARNESS FOR MOISTENED-TISSUE DISPENSER

BACKGROUND OF INVENTION

1. Field of Invention:

This invention relates generally to devices for supporting a moistened-tissue dispenser adjacent a conventional toilet tissue bathroom fixture so that either type of tissue is available to a user, and more particularly to a harness for suspending a moistened-tissue dispenser from the retractable spindle of the holder supporting a toilet tissue roll.

2. Status of Prior Art:

The typical bathroom is provided with a toilet-tissue roll fixture which takes the form of a holder having a pair of projecting posts or arms having bearing sockets therein to receive the journal ends of a spring-biased retractable spindle on which the roll is supported.

Dry toilet-tissue is inadequate for carrying out a thorough cleansing function, and it is now the practice to provide a moistened-tissue dispenser to make available a moistened tissue at the conclusion of the usual toilet ritual. Pre-moistened tissues are also useful for those suffering from hemorrhoids.

Because toilet paper is dry and relatively harsh, in recent years mothers of babies have switched to moistened towelettes in the form of absorbent paper saturated with an antiseptic solution. These towelettes are commercially available in so-called WET WIPES dispensers in the form of a cylindrical can having a roll of moistened tissue which is transversely perforated along the length of the tissue web to create a succession of individual tissues which are withdrawn, one at a time, through an orifice in a removable cover, the individual tissues being torn off adjacent the orifice.

Though the typical toilet room or bathroom has installed on a wall a toilet-tissue roll fixture, there is often no convenient shelf space available for a WET WIPES dispenser so that it is readily accessible to the user.

With a view to solving this problem, the patents to Boone provide various means to this end. Thus in Boone U.S. Pat. No. 4,004,687, a cylindrical can-type dispenser for moistened tissues is embraced by a ring that merges with a hook that hitches onto one of the projecting posts of a conventional toilet-tissue roll fixture, thereby positioning the dispenser adjacent one end of the toilet-tissue roll.

In Boone U.S. Pat. No. 4,235,333, the bathroom fixture for the toilet-tissue roll is provided with an extension plate on which a box of moistened tissues is bracketed. A similar arrangement is shown in Boone U.S. Pat. No. 4,106,617. The practical objection to these arrangements is that it requires a modification of the existing toilet-tissue roll holder, for one cannot mount the moistened tissue box on a standard holder.

In Boone U.S. Pat. No. 4,106,616, in order to support a moistened tissue dispenser in a box or a cylindrical can form from a conventional toilet-tissue roll holder, a rigid arm is provided having a concave notch at its upper end for hitching the arm onto one end of the spindle of the holder. The other end of the rigid arm is bifurcated to provide a support for the box or can. The practical objection to this arrangement as well as to that shown in Boone U.S. Pat. No. 4,004,687 is that because the attachment is to one post of the holder or to one end of the spindle, it is unstable and does not afford adequate support for the moistened tissue dispenser.

SUMMARY OF INVENTION

In view of the foregoing, the main object of this invention is to provide a harness for hitching a moistened tissue dispenser of the cylindrical can type onto opposite journal ends of the retractable spindle of a conventional toilet-tissue holder, whereby the dispenser is stably suspended below the holder.

A significant advantage of a harness in accordance with the invention is that it places the moistened tissue dispenser in symmetrical relation to the toilet-tissue roll thereabove, so that the wall surface on either side of the toilet-tissue holder is uncluttered, and the user has ready access either to a toilet-tissue or to a moistened tissue directly therebelow.

Also an object of the invention is to provide a harness of the above type which is easy to install, and which may be manufactured at low cost.

A salient feature of a harness in accordance with the invention is that it is formed of a single piece of thin, synthetic plastic material which may be die-cut from a blank of plastic sheeting.

Briefly stated, these objects are attained in a harness for hitching a moistened tissue dispenser onto a conventional toilet-tissue roll holder so that a user has ready access to either type of tissue. The dispenser is formed by a cylindrical can housing a roll of pre-moistened tissue perforated along its length to provide individual tissues that are successively withdrawn through an orifice in the cover of the can below which is an annular groove.

The harness, which is formed of flexible plastic material, consists of a hoop adapted to encircle the can groove and a pair of straps extending from the hoop at diametrically opposed positions. Adjacent the free end of each strap is a hole, making it possible to link the strap to an end journal of a spring-biased, retractable spindle supporting the toilet-tissue roll, the spindle journals being received in bearing sockets on the holder. The straps suspend the moistened tissue dispenser below the toilet-tissue roll.

BRIEF DESCRIPTION OF DRAWING

For a better understanding of the invention as well as other objects and further features thereof, reference is made to the following detailed description to be read in conjunction with the accompanying drawing, wherein:

FIG. 1 is a perspective view of a harness in accordance with the invention, which is shown hitching a standard moistened towel dispenser from the spindle of a conventional toilet-tissue roll bathroom fixture;

FIG. 2 is an exploded view of the cylindrical can and cover of the dispenser;

FIG. 3 is a plan view of one preferred embodiment of the harness;

FIG. 4 is a plan view of another embodiment of the harness; and

FIG. 5 is a sectional view taken through one post of the toilet-tissue roll holder and the spindle journaled therein.

DESCRIPTION OF INVENTION

Referring now to FIG. 1, a conventional toilet-tissue roll holder is shown, the holder being formed of a metal plate 10 having a concave depression 11 therein to accommodate a toilet tissue roll 12 supported on a spring-biased, retractable spindle 13. The opposite ends of the spindle are formed as journals 13J (one of which is shown in FIG. 5). Each journal is received in a bearing socket or recess formed in arms or posts 14 that project from plate 10 on either side of depression 11. This holder is installed on a wall in a bathroom or toilet at a position convenient to those using the facility.

Also shown is a moistened-tissue dispenser, generally identified by reference numeral 15. The dispenser, which is conventional and commercially available in supermarkets and other retail establishments, is formed by a cylindrical can 16, molded of synthetic plastic, flexible material, such as polyethylene, and a removable cover 17 whose circular flange 17F engages the rim 16M of can 16 surrounding its mouth.

Housed within can 16 is a roll of pre-moistened tissues which is transversely perforated at equi-spaced positions along its length. The leading end of the tissue web is bunched to pass through an orifice 18 in cover 17. Attached by a short retainer to cover 17 is a removable cap 19 to seal the orifice when the dispenser is not in use. By withdrawing the leading moistened tissue from the orifice and pulling on it to separate this tissue from the web on the perforation line, the user is provided with an individual tissue. A tissue tail 20 is left which is outside of the orifice to permit the withdrawal of the succeeding moistened tissue on the roll. Hence it is as easy for the user to obtain a moistened tissue from the dispenser as to obtain dry tissues from the perforated toilet tissue roll.

As shown in FIG. 2, can 16 is provided with an annular bead 16B which is engaged by the flanges of cover 17 to retain the cover on the can. An annular groove 16G is defined by the space between bead 16B and a shoulder 16S on the can.

For the purpose of hitching dispenser 15 onto the toilet-tissue holder, a harness is provided which in the embodiment illustrated in FIG. 4 is formed of flexible, synthetic plastic material. In practice the harness may be derived from a multi-ply plastic sheet that is die-cut to create the harness. The harness consists of a circular hoop 21 is adapted to encircle annular groove 16G of the dispenser can, and a pair of straps 22A and 22B integral with the hoop and extending from diametrically-opposed positions thereon.

The free end of each strap is provided with a series of equi-spaced holes H, making it possible to link the straps to the journal ends of a spindle 13 of the toilet-tissue holder, as shown in FIG. 5. Thus when journal 13J passes through a selected hole H in strap 22A, the free end of the strap is then sandwiched between the holder post 14 and the spindle and the strap is then trapped in place.

Thus after hoop 21 is attached to can 15 and straps 22A and 22B are locked to the journal ends of spindle 13, as shown in FIG. 1, the moistened-tissue dispenser 15 is suspended from the toilet tissue holder and is symmetrically disposed below toilet-tissue roll 12. Hence the user has ready access to either type of tissue, and the wall on which the holder is mounted is uncluttered on either side of the holder.

Because of the series of holes H, the installer, by selecting a particular hole, can adjust the effective length of the straps and hence the distance between the toilet-tissue roll and the moistened tissue dispenser.

The embodiment of the harness shown in FIG. 3 is of simpler design, and it consists of a hoop 23 and straps 24A and 24B each terminating in a disc-shaped lug (25A and 25B) having a central hole, so that in this embodiment the effective length of the strap is not adjustable. The diameter of the lug matches that of the spindle. The first hole in the straps in the embodiment shown in FIG. 4 is also in a disc-shaped lug.

While there has been shown and described a preferred embodiment of a harness for moistened-tissue dispenser in accordance with the invention, it will be appreciated that many changes and modifications may be made therein without, however, departing from the essential spirit thereof. Thus the harness may be designed to suspend a box of moistened tissue dispensers from the toilet-tissue holder, in which case the geometry of the hoop is not circular but is shaped to engage the box.

I claim:

1. A harness for hitching a moistened tissue cylindrical dispenser from a toilet-tissue holder provided with a spring-biased, retractable spindle for supporting a roll of toilet tissue, said spindle having end journals received in bearings on a pair of posts projecting from a holder plate, said harness being formed of a single piece of flexible, synthetic plastic material and comprising:

(a) a hoop adapted to encircle and engage the dispenser; and (b) a pair of straps integral with the hoop and extending from opposing positions on the hoop, each strap having at least one hole adjacent its free end into which a respective end journal of the spindle is inserted so that the strap is sandwiched between a respective post and the spindle and is thereby linked to the spindle to suspend the dispenser below the holder.

2. A harness as set forth in claim 1, for hitching from the holder a dispenser in cylindrical form having an annular groove, said hoop being circular and being dimensioned to encircle the groove, said straps extending from diametrically-opposed positions on the circular hoop.

3. A harness as set forth in claim 1, wherein said single piece harness is die-cut from a multi-ply blank of synthetic plastic sheeting.

4. A harness as set forth in claim 1, wherein each strap is provided along its length adjacent the free end thereof with a series of equi-spaced holes, whereby the effective length of the strap may be adjusted.

5. A harness as set forth in claim 1, wherein the free end of each strap terminates in a disc-shaped lug having said hole therein, said lug having a diameter matching that of the spindle.

6. A harness as set forth in claim 1, wherein said harness is formed of polyethylene.

* * * * *